United States Patent [19]

Asahi

[11] Patent Number: 4,510,655

[45] Date of Patent: Apr. 16, 1985

[54] SLIDE FASTENER ASSEMBLY FOR CASE OR FOLDER

[75] Inventor: Sadaho Asahi, Uozu, Japan

[73] Assignee: Yoshida Kogyo K. K., Tokyo, Japan

[21] Appl. No.: 502,517

[22] Filed: Jun. 9, 1983

[30] Foreign Application Priority Data

Jun. 18, 1982 [JP] Japan ..... 57-91106

[51] Int. Cl.[3] ..... A44B 19/02

[52] U.S. Cl. ..... 24/382; 24/408; 24/414

[58] Field of Search ..... 24/381, 382, 408, 413, 24/414, 411, 574, 592, 631

[56] References Cited

U.S. PATENT DOCUMENTS

| | | | |
|---|---|---|---|
| 1,613,665 | 1/1927 | Light | 24/414 |
| 2,073,380 | 3/1937 | Roseman | 24/414 |
| 2,368,911 | 2/1945 | Andler | 24/381 |
| 2,483,057 | 9/1949 | Levering | 24/382 |
| 3,477,553 | 11/1969 | Kish, Jr. | 24/382 |
| 4,112,552 | 9/1978 | Lee | 24/382 |
| 4,186,467 | 2/1980 | Lawrence | 24/408 |

FOREIGN PATENT DOCUMENTS

| | | | |
|---|---|---|---|
| 959390 | 3/1950 | France | 24/414 |
| 56-27243 | 6/1981 | Japan . | |
| 428469 | 5/1935 | United Kingdom | 24/414 |
| 696722 | 9/1953 | United Kingdom | 24/381 |
| 1438231 | 6/1976 | United Kingdom | 24/414 |

*Primary Examiner*—Victor N. Sakran

*Attorney, Agent, or Firm*—Hill, Van Santen, Steadman & Simpson

[57] ABSTRACT

A slide fastener assembly, for a case or folder having a pair of outer walls and at least one intermediate wall or partition, comprises a pair of laterally spaced outer tapes carrying on their inner longitudinal edges a pair of coupling element rows and adapted to be attached to a pair of outer walls of the case, and at least one intermediate tape carrying on opposite longitudinal edges a pair of coupling element rows. Each coupling element row on the intermediate tape is interengageable with the coupling element row on a respective one of the outer tapes. The intermediate tape has a pair of juxtaposed longitudinal flap portions projecting from one face of the intermediate tape and adapted to the attached astride an intermediate wall of the case.

2 Claims, 8 Drawing Figures

SLIDE FASTENER ASSEMBLY FOR CASE OR FOLDER

BACKGROUND OF THE INVENTION

1. Field of the Invention:

The present invention relates to slide fasteners, and more particularly to a slide fastener assembly for closure of a case or folder having a pair of outer walls and at least one intermediate wall or partition.

2. Description of the Prior Art:

As disclosed in U.S. Pat. No. 2,483,057 and Japanese Patent Publication (Kokoku) No. 56-27243, a known slide fastener for a case or folder comprises a pair of spaced outer stringers adapted to be attached to a pair of outer walls, respectively, of the case, and an intermediate stringer adapted to be attached to an intermediate wall or partition of the case. The outer stringers have on their inner longitudinal edges a pair of rows of ordinary or single-headed coupling elements, and the intermediate stringer has on one longitudinal edge a row of special or double-headed coupling elements that is interengageable on opposite sides with the respective rows of ordinary coupling elements of the outer stringers in such a manner that the outer and intermediate stringers are disposed in generally T-shaped configuration as viewed in transverse cross section. Following are common problems with the prior slide fastener:

(1) Because of their special structure, double-headed coupling elements cannot be manufactured at low cost, thus making the slide fastener expensive.

(2) In attachment of the slide fastener to the case, the intermediate stringer's tape is sewn or bonded to the intermediate wall of the case, while the intermediate stringer tape is simply put over a peripheral portion of the intermediate case wall only at one face thereof, which causes unstable positioning and thus inaccurate attachment of the intermediate stringer.

(3) Since the intermediate stringer is secured to the intermediate case wall with the peripheral portion of the latter being left floating, the peripheral portion is not embraced by the stringer tape or any other part and hence tends to be caught by a slider.

FIG. 1 of the accompanying drawings illustrates another prior slide fastener in which an intermediate stringer 1 comprises a tape of T-shaped cross section including a pair of horizontal tape sections 2, 3 carrying on their outer longitudinal edges a pair of rows of ordinary coupling elements, and a vertical tape section 4 projecting downwardly from the joint of the two horizontal tape sections 2, 3. The intermediate stringer 1 is interengageable on opposite sides with a pair of outer stringers 5, 6 by means of a pair of sliders 7, 8, respectively, the respective tapes of the outer stringers 5, 6 being sewn to a pair of outer walls 9, 10 of a case. In this prior art, like the prior art of U.S. Pat. No. 2,483,057 and Japanese Patent Publication No. 56-27243, the vertical tape section 4 of the intermediate stringer 1 is sewn to an intermediate case wall 11 with the peripheral portion 11*a* of the later being left floating; therefore this peripheral portion 11*a* tends to be caught by the slider 7.

SUMMARY OF THE INVENTION

According to the present invention, a slide fastener assembly, for a case having a pair of outer walls and at least one intermediate wall, comprises a pair of laterally spaced outer tapes carrying on their inner longitudinal edges a pair of coupling element rows and adapted to be attached to the outer walls of the case, and at least one intermediate tape carrying on opposite longitudinal edges a pair of coupling element rows. Each coupling element row on the intermediate tape is interengageable with the coupling element row on a respective one of the outer tapes. The intermediate tape has a pair of juxtaposed longitudinal flap portions projecting from one face of the intermediate tape and adapted to be attached astride the intermediate wall of the case.

It is an object of the present invention to provide a slide fastener assembly, for a case or folder, which can be attached to the case accurately and stably with maximum ease.

Another object of the invention is to provide a slide fastener assembly, for a case or folder, which is simple in construction and hence can be manufactured less costly.

Still another object of the invention is to provide a slide fasener assembly, for a case or folder, in which the peripheral portion of an intermediate wall of the case is free from being caught by a slider.

Many other advantages, features and additional objects of the present invention will become manifest to those versed in the art upon making reference to the detailed description and the accompanying drawings in which preferred embodiments incorporating the principles of the present invention are shown by way of illustrative example.

BRIEF DESCTRIPTION OF THE DRAWINGS

DETAILED DESCRIPTION

Figure 1:
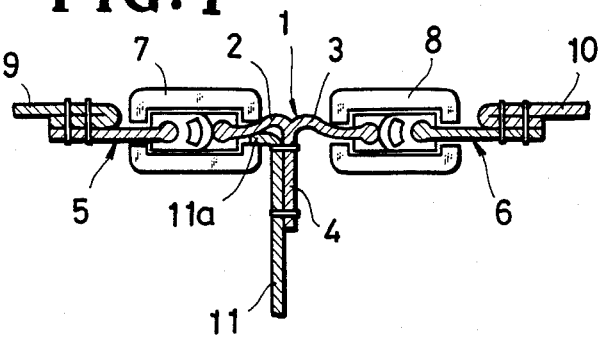
FIG. 1 PRIOR ART
FIG. 1 is a schematic transverse cross-sectional view of a prior art slide fastener assembly.
Figure 2:
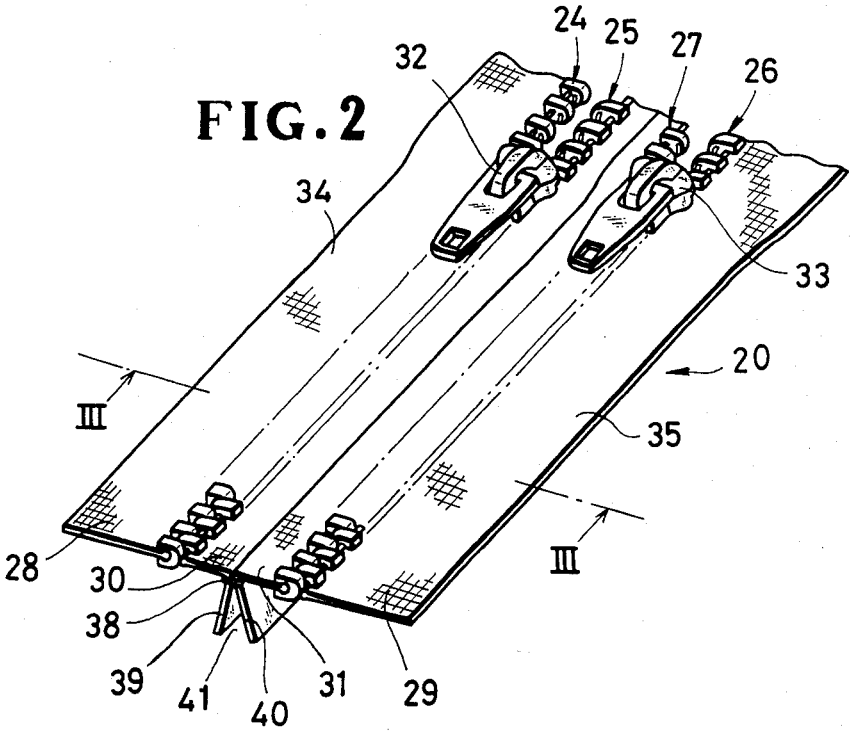
FIG. 2 is a fragmentary perspective view of a slide fastener assembly embodying the present invention.

FIG. 2 shows a slide fastener assembly 20 for a case or folder having a pair of outer walls 21, 22 (FIG. 4) and an intermediate wall or partition 23.

Figure 4:
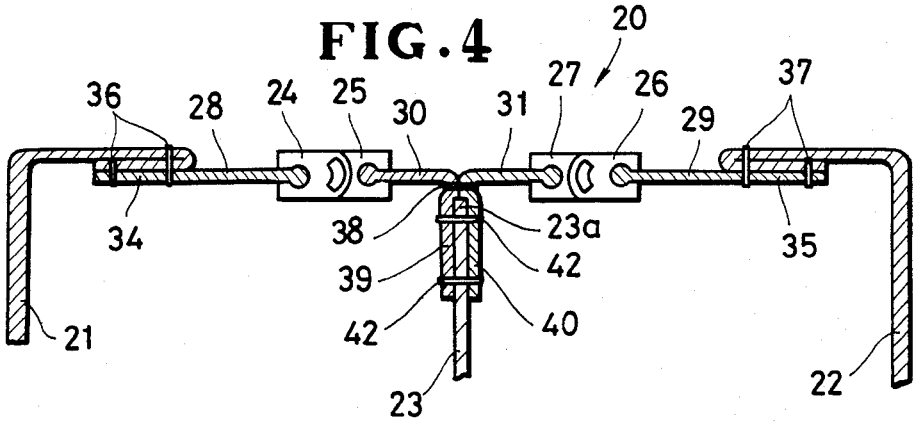
FIG. 4 is a transverse cross-sectional view showing the slide fastener assembly having been attached to a case.

The slide fastener assembly 20 comprises two pairs of laterally spaced rows of coupling elements 24, 25; 26, 27, a pair of outer tapes 28, 29 carrying on their respective inner longitudinal edges the outer rows of coupling elements 24, 26, and a pair of intermediate tapes 30, 31 carrying on their respective outer longitudinal edges the inner rows of coupling elements 25, 27. A pair of sliders 32, 33 is threaded one on each pair of coupling elements 24, 25; 26, 27. The outer tapes 28, 29 have respective outer longitudinal margins 34, 35 which are adapted to be attached to the outer walls 21, 22, respectively, of the case by means of sewn stitches 36, 37, as shown in FIG. 4.

Each of the intermediate tapes 30, 31 is bent along its full length into a generally L-shaped cross section; the two intermediate tapes 30, 31 thus have a pair of juxtaposed flap portions 39, 40, respectively, which serves as attachment margins to be attached to the intermediate case wall 23 as described below. The two intermediate tapes 30, 31 are joined along the bases of the flap portions 39, 40 by means of sewn stitches 38 so as to provide a generally triangular space 41 (for a purpose described below) between the two flap portions 39, 40.

Figure 3:
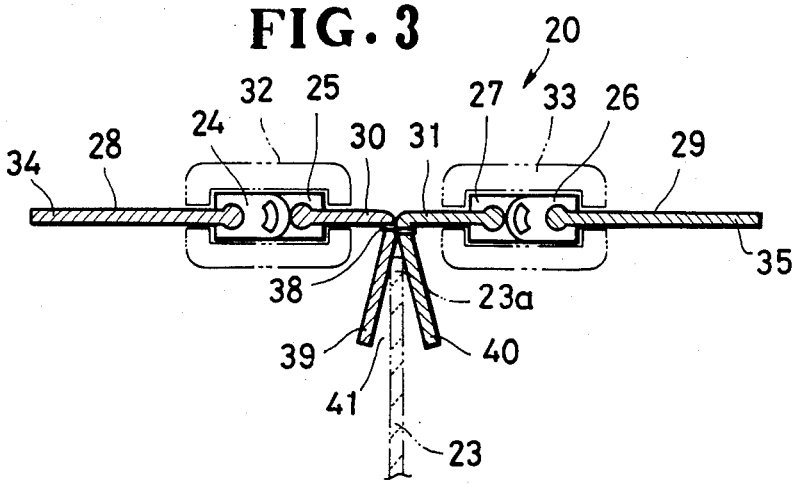
FIG. 3 is an enlarged cross-sectional view taken along line III—III of FIG. 2.

To attach the intermediate tapes 30, 31 to the intermediate wall 23 of the case, the two flap portions 39, 40 are placed astride the intermediate wall 23, as shown in FIG. 3. At that time, since the two flap portions 39, 40 are flared, the upper margin 23*a* of the intermediate wall 23 is allowed to enter the inter-flap space 41 with maximum ease. Further, the flared flap portions 39, 40 guide the upper margin 23*a* of the intermediate wall 23 until the upper margin 23*a* reaches the joint of the two intermediate tapes 30, 31, causing accurate and easy positioning of the flap portions 39, 40 on the intermediate case wall 23.

With the upper margin 23*a* of the intermediate wall 23 thus sandwiched between the two flap portions 39, 40, the latter are secured to the intermediate wall 23 by sewn stitches 42. Having been embraced by the flap portions 39, 40, the upper margin 23*a* of the intermediate wall 23 is prevented from being accidentally caught by either slider 32, 33. For the same reason it is possible to attach the intermediate wall 23 to the intermediate tapes 30, 31 accurately and stably.

Further, because no double-headed coupling elements are employed, the slide fastener assembly 20 can be manufactured solely from ordinary slide fasteners, which have single-headed coupling elements and are hence inexpensive.

Figure 5:
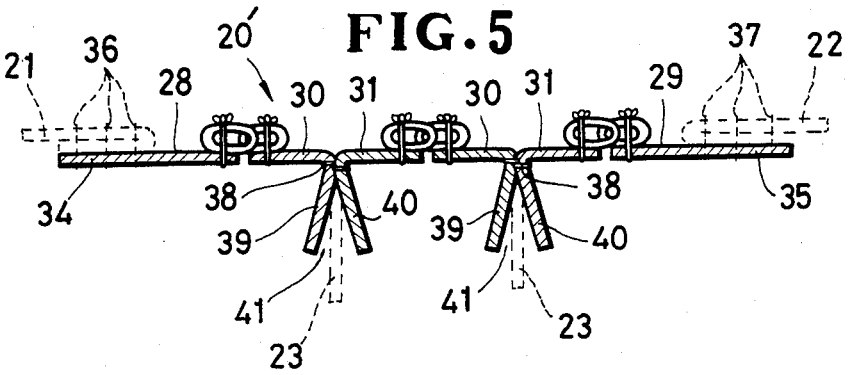
FIG. 5 is a transverse cross-sectional view of a slide fastener assembly according to a second embodiment.

FIG. 5 shows a slide fastener assembly, 20' according to a second embodiment, which is suitable for a case or folder having two intermediate walls 23, 23. The slide fastener assembly 20' includes two pairs of intermediate tapes 30, 31; 30, 31; each pair of intermediate tape 30, 31 has a pair of juxtaposed longitudinal flap portions 39, 40 adapted to be mounted astride the upper margin 23*a* of a respective one of the intermediate walls 23.

Figure 6:
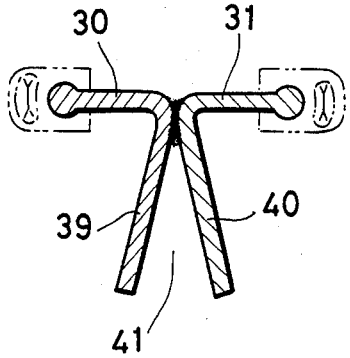
FIG. 6 is a transverse cross-sectional view of a modification of an intermediate tape.
Figure 7:
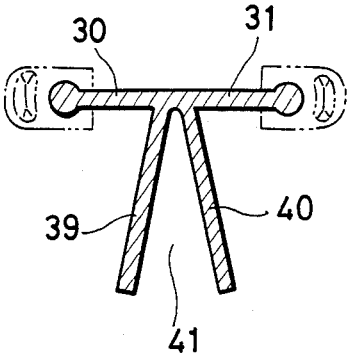
FIG. 7 is a transverse cross-sectional view similar to FIG. 6, showing a further modification of the intermediate tape.

In the embodiments of FIGS. 2–5, the intermediate tapes 30, 31 of an adjacent pair may be bonded, with a known adhesive, along the bases of the adjacent flap portions 39, 40, as shown in FIG. 6. Alternatively, the intermediate tapes 30, 31 of an adjacent pair may be formed integrally with one another in a known manner, such as weaving, knitting or extrusion-molding, as shown in FIG. 7.

Figure 8:
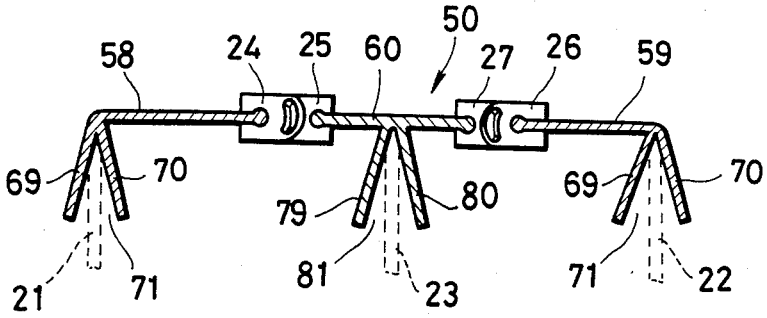
FIG. 8 is a transverse cross-sectional view of a slide fastener assembly according to a third embodiment.

FIG. 8 shows a modified slide fastener assembly 50 according to a third embodiment. The slide fastener assembly 50 comprises two pairs of laterally spaced rows of coupling elements 24, 25; 26, 27, a pair of outer tapes 58, 59 carrying on their respective inner longitudinal edges the outer rows of coupling elements 24, 26, and an intermediate tape 60 carrying on, opposite longitudinal edges the inner rows of coupling elements 25, 27. Each of the outer tapes 58, 59 has along its outer longitudinal edge a pair of juxtaposed longitudinal flap portions 69, 70 defining therebetween a triangular space 71 and adapted to be mounted astride a respective one of the outer case walls 21, 22. The flap portions 69, 70 are integrally formed with a respective one of the outer tapes 58, 59 in a known manner, such as weaving, knitting or extrusion-molding. The intermediate tape 60 has a pair of juxtaposed longitudinal flap portions 79, 80 projecting downwardly from the midportion of the intermediate tape 60 and defining therebetween a generally triangular space 81. The flap portions 79, 80 are adapted to be mounted astride the intermediate case wall 23. The flap portions 79, 80 are integrally formed with the intermediate tape 60. With the flap portions 69, 70, 79, 80, accurate and easy attachment of the slide fastener assembly 50 to the case can be achieved.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A slide fastener assembly for a case having a pair of outer walls and at least one intermediate wall, comprising:

(a) a plurality of laterally spaced pairs of rows of only single-headed coupling elements;

(b) a pair of outer tapes carrying, on their respective inner edges, outermost rows of said coupling elements and adapted to be attached to the respective outer walls of the case; and (c) a pair of L-shaped intermediate tapes having leg portions disposed between two adjacent pairs of said coupling element rows, and other leg portions transverse to and sewn to said first-named leg portions the latter carrying, on opposite longitudinal edges, respective inner rows of said adjacent two pairs of coupling element rows, said other leg portions of said intermediate tapes being adapted to be attached astride the intermediate wall of the case.

2. A slide fastener assembly according to claim 1, each of said outer tapes having a pair of juxtaposed longitudinal flap portions projecting from one face thereof and adapted to be mounted astride a respective one of the outer walls of the case.

* * * * *